United States Patent [19]

Swatzell

[11] 4,327,452

[45] May 4, 1982

[54] NECK CUSHIONING PAD

[76] Inventor: Lillian Swatzell, Bartlett St., Box 416, Homer, Ak. 99603

[21] Appl. No.: 177,473

[22] Filed: Aug. 12, 1980

[51] Int. Cl.[3] ..... A54D 44/10; A54D 19/00; A54D 19/08

[52] U.S. Cl. ..... 4/523; 4/515; 4/519

[58] Field of Search ..... 4/515, 519, 523, 515

[56] References Cited

U.S. PATENT DOCUMENTS

| | | | |
|---|---|---|---|
| 1,855,864 | 4/1932 | Mjaaland et al. | 4/519 |
| 2,194,804 | 3/1940 | Mayhew | 4/519 |
| 2,261,476 | 11/1941 | Kiefer | 4/519 |
| 2,475,259 | 7/1949 | Singleton | 4/515 |
| 2,494,957 | 1/1950 | Morgan | 4/523 |
| 2,818,585 | 1/1958 | Compbell | 4/523 |
| 2,948,903 | 8/1960 | Gilmer | 4/523 |
| 3,283,344 | 11/1966 | Blanchard | 4/523 |
| 3,545,012 | 12/1970 | Espin | 4/523 |

*Primary Examiner*—Henry K. Artis

*Attorney, Agent, or Firm*—Burns, Doane, Swecker & Mathis

[57] ABSTRACT

An apparatus for covering the hard surface of a barber shop or beauty parlor sink to protect the neck of a customer whose hair is being shampooed, is disclosed. The apparatus includes a flexible, resilient cushion adapted to overlie a portion of a sink. The sink includes a bowl having an inner bowl surface, a substantially horizontal surface connected to and projecting outwardly form a top edge of the bowl, and a downwardly directed surface connected to the substantially horizontal surface. The cushion includes a first portion adapted to overlie a portion of the bowl surface, a second portion integrally connected to the first portion and adapted to overlie a portion of the substantially horizontal surface, and a third portion integrally connected to said second portion and adapted to overlie a portion of the downwardly directed surface. The first and third portions are resiliently inclined toward one another and tend to grip the sink when mounted on the sink. The cushion also includes a top surface, a portion of which top surface is covered by a relatively thin layer of silicone.

11 Claims, 7 Drawing Figures

FIG. 1
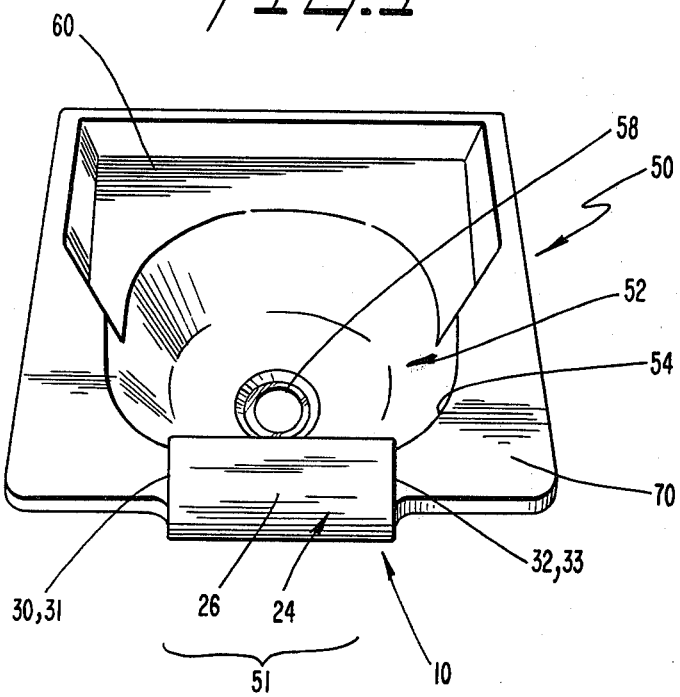
FIG. 2
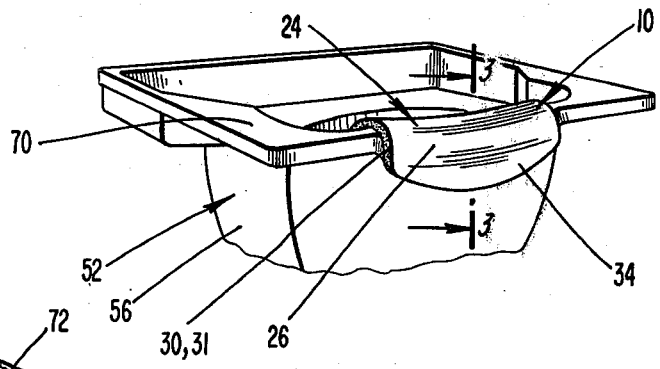
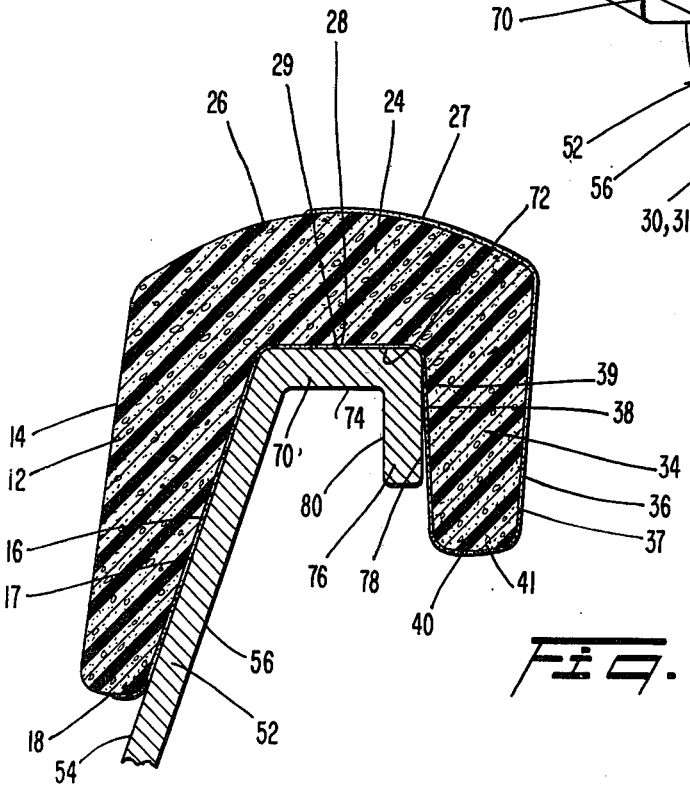
FIG. 3

NECK CUSHIONING PAD

BACKGROUND AND SUMMARY OF THE PRESENT INVENTION

The present invention pertains generally to barber shop and beauty parlor equipment, and more particularly relates to a cushion adapted to cover the hard surface of a barber shop or beauty parlor sink to cushion and protect the neck of a customer from the hard surface of the sink.

Various devices are known for cushioning the necks of barber shop and beauty parlor customers from the hard surfaces of sinks. Three such devices are disclosed in U.S. Pat. No. 2,948,903 issued to Gilmer, U.S. Pat. No. 2,261,476 issued to Kiefer, and U.S. Pat. No. 2,818,585 issued to Campbell.

The Gilmer patent (U.S. Pat. No. 2,948,903) discloses a neck rest which is to be placed over a notched portion of a forward wall of a hair shampoo bowl, which forward wall includes an outwardly and laterally directed flange at an upper edge. The Gilmer neck rest includes a U-shaped body of resilient sheet material having a long flat leg, a relatively short leg, and a bight portion which connects the long leg to the relatively short leg. The bight portion is adapted to lie directly in the notch of the forward wall of the shampoo bowl, and conforms to the contour of the notch. The relatively long leg of the U-shaped body is adapted to overlie an inner surface of the forward wall of the shampoo bowl, while the relatively short leg, which includes an inwardly curled portion, is adapted to engage the laterally directed flange. The U-shaped body is stiff, yet resilient enough to be snapped into position and to be removed without the use of tools. The Gilmer neck rest also includes a pad, which may be of sponge rubber, which is bonded directly to the outer face of the bight portion of the U-shaped body. A sheet of water repellent material overlies the pad and has its marginal portions bonded directly to the face of the U-shaped body. The pad is intended to receive the neck of a user of the hair shampoo bowl and to protect the user's neck from direct contact with the wall of the shampoo bowl.

The Kiefer Patent (U.S. Pat. No. 2,261,476) discloses a neck rest for a front wall of a shampoo bowl, which front wall includes an arcuate depression. The neck rest, which is adapted to be received in the arcuate depression, includes a central portion which has a lower surface complementary to the depression and adapted to seat therein. An apron and two flanges which depend from the central portion enable the Kiefer neck rest to straddle the upper edge of the wall of the shampoo bowl. Attached to the central portion of the neck rest is a ratchet bar which extends through an opening in the lower edge of a ratchet frame attached to an outer surface of the front wall of the shampoo bowl. The Kiefer neck rest also includes a pawl mechanism which engages the ratchet bar, whereby the ratchet bar and neck rest may be raised or lowered to a desired elevation and fixed at that desired elevation. An upper surface of the central portion of the Kiefer neck rest includes an arcuate depression within which is received a neck rest pad. The neck rest pad may be formed of a soft resilient material such as sponge rubber. The pad includes a central portion as well as side flanges which grip the Kiefer neck rest to retain the pad in place.

The Campbell patent (U.S. Pat. No. 2,818,585) discloses a shampooing device having a tray with a cushioned neck accommodating portion. The shampooing device includes a water retaining tray having a substantially heart shaped flat floor and a forward wall with a neck accommodating curve formed therein. A cushion is provided for the forward wall of the tray and is molded substantially in the shape of the forward wall and the neck accommodating curve in that wall. The cushion is provided with a centrally positioned narrow slot throughout its curved extent, by means of which the cushion is mounted on the forward wall of the tray. The cushion is preferably formed of foam rubber.

Other barber shop and beauty parlor neck cushioning devices are disclosed in the following patents: U.S. Pat. No. 2,803,834 issued to McClung; U.S. Pat. No. 1,244,715 issued to Dozier et al; U.S. Pat. No. 1,882,624 issued to Jackson; U.S. Pat. No. Des. 102,809 issued to Wutzler; and U.S. Pat. No. Des. 199,782 issued to Rankin.

Customers who come to barber shops or beauty parlors to have their hair shampooed often wish to have their necks cushioned and protected from the hard surfaces of the sinks where the shampooing operations are performed. This is particularly true of, and important to, elderly customers as well as young children. Barber shop and beauty parlor operators are naturally desirous of accommodating their customers and of making them as comfortable as possible during shampooing and other operations. Thus, various neck cushioning devices, such as those described above, have been used in barber shops and beauty parlors in the past. Although barber shop and beauty parlor operators do wish to make their customers comfortable, for reasons of economy, utility, and cleanliness, barber shop and beauty parlor operators would naturally prefer to use neck cushioning devices which are inexpensive while also effective, readily adaptable to any sink, simple to use, readily sanitized, reusable, and water repellant.

Accordingly, a primary object of the present invention is to provide a relatively inexpensive neck cushioning device to protect the neck of a barber shop or beauty parlor customer from the hard surface of a sink.

A further object of the present invention is to provide a neck cushioning device which is effective, readily adaptable to any sink, and simple to use.

Yet another object of the present invention is to provide a neck cushioning device which may be readily and easily sanitized and is thus reusable.

Still another object of the present invention is to provide a neck cushioning device which is water repellant.

A neck cushioning device adapted to overlie a portion of the hard surface of a sink having a bowl surface, a substantially horizontal surface connected to and projected outwardly from a top edge of the bowl, and a downwardly directed surface connected to the substantially horizontal surface, according to the present invention, includes a flexible, resilient cushion having a top surface, which cushion is adapted to overlie a portion of the sink. The cushion includes a first portion adapted to overlie a portion of the bowl surface, a second portion integrally connected to the first portion and adapted to overlie a portion of the substantially horizontal surface, and a third portion integrally connected to the second portion and adapted to overlie a portion of the downwardly directed surface. The first portion and the third portion of the cushion are resiliently inclined toward one another, so that when the cushion is mounted on the sink the first and third portions grip the sink. A portion of the top surface of the cushion preferably includes a relatively thin layer of silicone.

BRIEF DESCRIPTION OF THE DRAWINGS

A preferred embodiment of the present invention is described with reference to the accompanying drawings wherein like members bear like reference numerals and wherein:

FIG. 1 is a first perspective view of a preferred embodiment of the neck rest pad of the present invention, arranged over a sink;

FIG. 2 is a second perspective view of the neck rest pad of FIG. 1 arranged over the sink;

FIG. 3 is a view along the line 3—3 of FIG. 2;

DETAILED DESCRIPTION OF THE PREFERRED EMBODIMENT

Figure 4:
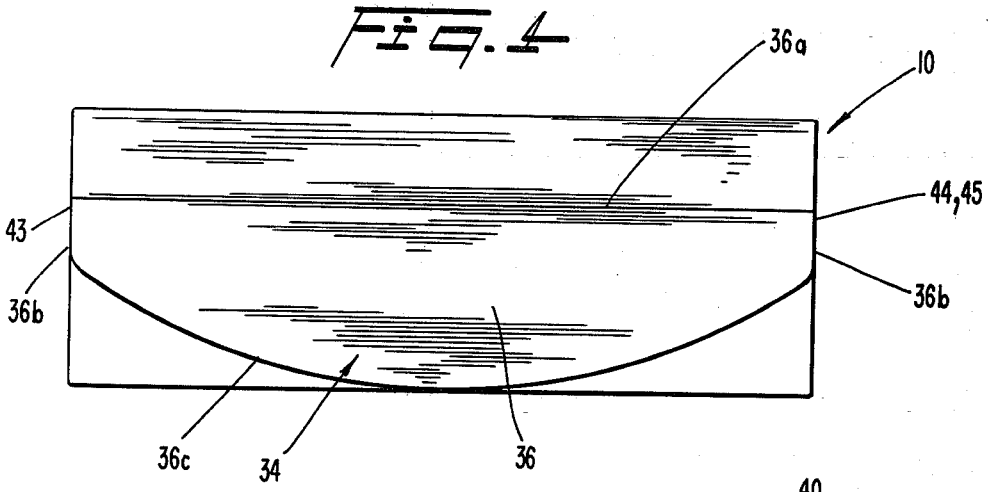
FIG. 4 is a front view of the neck rest pad, according to the present invention.

With reference to FIGS. 1 and 2, a device to cushion and protect the neck of an individual from the hard surface of a sink, according to the present invention, includes a flexible, resilient, generally U-shaped cushion or pad 10 adapted to overlie a forward portion of the hard surface of a sink. The neck pad 10 according to the present invention will be described in connection with a suitable, conventional sink 50. The neck pad can of course be utilized with sinks of other configuration in a manner which is readily obvious to one skilled in the art upon reading the present disclosure.

The suitable, conventional sink 50 (as typically found in a barber shop or beauty parlor) includes a bowl 52 having an inner surface 54 and an outer surface 56. The sink 50 also includes a drain 58 to permit outflow of water as well as a ledge 60 on which conventional hot and cold water valves may be arranged.

Projecting outwardly and laterally from the upper periphery of the bowl 52, and connected to the top edge of the bowl 52, is a flange 70. As shown more clearly in FIG. 3, the flange 70 includes a substantially horizontal top surface 72 and a bottom surface 74. Connected to, and depending downwardly from the flange 70, is a lip 76 which extends about the periphery of the flange 70 and which includes a front surface 78 and a back surface 80.

The sink 50 could, for example, have an alternative configuration wherein the thickness of the wall of the bowl 52 is such that the outer surface of the bowl 52 is coincident with the front surface 78 of the lip 76. That is, the thickness of the wall of the bowl 52 could extend from the surface 54 to the surface 78. In cross-section, the outer contour of the wall of the bowl 52 would include the inner bowl surface 54, the surface 28 extending horizontally or laterally from the surface 54, and the surface 78 extending vertically downwardly from the surface 28 to the base of the bowl 52.

With reference generally to FIGS. 1–2, and particularly to FIG. 3, the flexible, resilient cushion 10 of the present invention, is adapted to overlie, for example, a forward portion 51 of the surface of the conventional sink 50, including a forward portion of the inner surface 54 of the bowl 52, a forward portion of the top surface 72 of the flange 70, and a forward portion of the front surface of the lip 76.

The flexible, resilient cushion 10, which is generally U-shaped in cross-section, includes three integrally connected portions 12, 24, and 34. The first portion 12 includes a top surface 14, a bottom surface 16 adapted to be placed immediately adjacent the forward portion of the inner surface 54 of the bowl 52, and a rounded lower edge surface 18 which connects the top and bottom surfaces 14 and 16. The first portion 12 also includes side surfaces 20 and 22 (see FIGS. 6 and 7).

The second portion 24, which is integrally connected to the first portion 12, includes a top surface 26 and a bottom surface 28, which bottom surface is adapted to be placed immediately adjacent the forward portion of the top surface 72 of the flange 70. The second portion 24 also includes side surfaces 30 and 32 (see FIGS. 1, 2, and 7).

The third portion 34, which is integrally connected to the second portion 24, also includes a top surface 36, a bottom surface 38 adapted to be placed immediately adjacent the forward portion of the front surface 78 of the lip 76, and a rounded lower edge surface 40 which connects the top and bottom surfaces 36 and 38. The third portion 34 also includes side surfaces 42 and 44 (see FIGS. 4 and 7).

Figure 5:
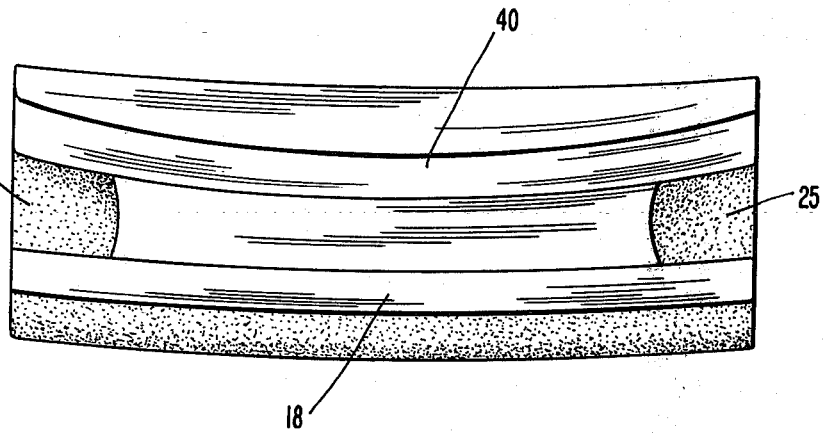
FIG. 5 is a bottom view of the neck rest pad of FIG. 4.
Figure 6:
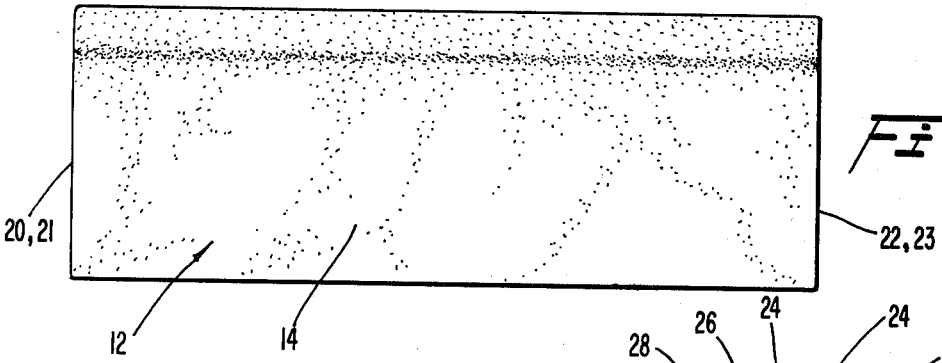
FIG. 6 is a rear view of the neck rest pad of FIG. 4.
Figure 7:
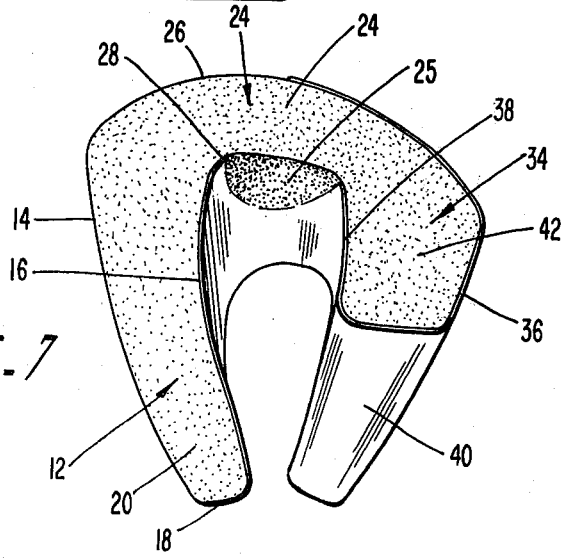
FIG. 7 is an end view of the neck rest pad of FIG. 4.

With reference to FIGS. 5–7, the outer contour of the top surface 14 of the first portion 12 is generally rectangular in shape (see FIG. 6). Although the various dimensions of a neck pad according to the present invention can be varied so as to correspond to the dimensions of the sink, a preferred embodiment of the neck pad has a width of the outer contour of the first portion 12 which is preferably two and a half inches while a length of the outer contour is preferably eight inches. The lower edge surface 18 of the first portion 12 (see FIG. 5), which is also substantially rectangular in outline, extends across the entire length of the first portion 12 and preferably has a width of three eighths of an inch.

As shown clearly in FIG. 7, the first portion 12 has an initial concave curvature (when not in place on the sink). That is, when viewed in cross-section, both the top surface 14 and bottom surface 16 of the first portion 12 have a concave curvature. Thus, because of this initial curvature, the lower end of the first portion 12, adjacent the surface 18, points toward the third portion 34. In addition, and as shown in FIG. 7, the thickness of the first portion generally increases in the direction of the second portion. Preferably, the thickness of the first portion increases smoothly from one quarter inch at the lower end of the first portion to one half inch at the opposite end of the first portion 12 (adjacent the second portion).

With reference to FIGS. 4, 5 and 7, the top surface 36 of the third portion 34 is substantially flat or planar (see FIG. 4). In outline, and as shown in FIG. 4, the contour of the top surface 36 includes a relatively long horizontal segment **36*a* and two relatively short vertical segments 36*b* at opposite ends of the horizontal segment 36*a*. A convexly curvatured third segment 36*c* connects the two vertical segments 36*b*. The length of the horizontal segment 36*a* is preferably eight inches, while the length of each of the vertical segments 36*b* is preferably three-quarters of an inch. At its widest point, that is, at the point where the distance from the horizontal segment 36*a* to the curved segment 36*c* is greatest, the third segment is preferably two inches. The lower edge surface 40 (see FIG. 5) of the third portion 34**, which extends across the entire length of the third portion, is gently curved and generally rectangular in outline. The width of the lower edge surface is preferably at least one-half inch.

As shown clearly in FIG. 7, the third portion 34 is inclined or canted toward the first portion 12. That is, both the top surface 36 and bottom surface 38 of the third portion 34 are canted toward the first portion. Thus, the lower end of the third portion, adjacent the edge surface 40, points toward the first portion 12. In addition, and as shown in FIG. 7, the thickness of the third portion generally increases in the direction of the second portion. Preferably, the thickness of the third portion increases smoothly from one-half inch at the lower end of the third portion to one inch at the opposite end of the third portion (adjacent the second portion).

With reference to FIGS. 1, 3, 5, and 7, the top surface 26 of the second portion 24 is substantially rectangular in outline (see FIG. 1). The length of the rectangular outline of the top surface 26 is preferably eight inches, while the width is preferably three inches.

As is clearly shown in FIGS. 3 and 7, the second portion 24 has a concave curvature. That is, the top surface 26 and bottom surface 28 both have a concave curvature when viewed in cross section. The second portion 24 is smoothly joined to the first and third portions. The thickness of the second portion is preferably one and a half inches.

With reference particularly to FIGS. 5 and 7, the second portion 24 includes a semi-circular groove 25 at each of the opposite ends of the second portion. The length of each of these grooves is preferably about one inch. When the neck pad 10 of the present invention is placed over the surface of the sink 50, the grooves 25 are large enough to enable one to insert a finger into each groove to easily remove the neck pad from the sink.

The concave curvature of the first portion of the pad 10, as well as the inclination of the third portion toward the first portion, coupled with the resiliency of the pad, provides the pad with a natural tendency to grip the bowl 52 and the lip 76 when in place. Because of the natural tendency of the pad 10 to grip the bowl 52 and the lip 76, the grooves 25 in the second portion are useful in enabling one to remove the pad from the sink with relatively little effort.

With reference to FIG. 3, each of the lower surfaces 16, 28 and 38 of the three integrally connected portions of the flexible, resilient cushion 10 preferably includes a relatively thin layer of water repellant silicone. That is, the bottom surface 16 of the first portion 12 includes a relatively thin layer of silicone 17 which is in flush contact with the inner surface 54 of the bowl 52. In addition, the bottom surface 28 of the second portion 24 also includes a relatively thin layer of silicone 29, which layer of silicone 29 is integrally connected to the layer of silicone 17. The relatively thin layer of silicone 29 is in flush contact with the top surface 72 of the flange 70. Finally, the lower surface 38 of the third portion 34 includes a relatively thin layer of silicone 39, which layer of silicone 39 is integrally connected to the layer of silicone 29. The relatively thin layer of silicone 39 of the lower surface 38 of the third portion 34 is in flush contact with the front surface 78 of the lip 76. The integrally connected layers of silicone 17, 29 and 39 make the lower surface of the flexible, resilient cushion 10 substantially impermeable to water and are also believed to assist in the ability of the surface to "grip" the adjacent surface of the sink.

Of the top surfaces of the three integrally connected portions of the flexible, resilient cushion 10, only the top surfaces of the second and third portions include relatively thin layers of silicone. That is, half the top surface 26 of the second portion 24, adjacent the third portion 34, includes a relatively thin layer of silicone 27. In addition, the entire top surface 36 of the third portion 34 also includes a relatively thin layer of silicone 37, which layer of silicone 37 is integrally connected to the layer of silicone 27. Furthermore, the lower rounded surface 40 which connects the bottom surface 38 to the top surface 36 of the third portion 34, also includes a relatively thin layer of silicone 41 which is integrally connected to the layers of silicone 37 and 39 which cover the top and bottom surfaces 36 and 38. On the other hand, neither the top surface 14 nor the lower rounded surface 18 of the first portion 11 includes a layer of silicone. Thus, the integrally connected layers of silicone covering half the top surface of the second portion 24 and the whole of the top surface of the third portion 34 of the cushion 10 are substantially impermeable to water, while the top surface of the first portion 12 and half the top surface of the second portion 24, adjacent the first portion, are permeable to water (at least to the extent that the material of these portions of the pad are permeable to water).

All of the side surfaces of the first, second, and third portions of the cushion 10 also preferably include relatively thin layers of silicone. That is, the side surfaces 20 and 22 of the first portion 12 include, respectively, relatively thin layers of silicone 21 and 23 (see FIG. 6) which are integrally connected to the layer of silicone 17 covering the bottom surface 16 of the first portion. Similarly, the side surfaces 30 and 32 of the second portion 24 include, respectively, relatively thin layers of silicone 31 and 33 (see FIG. 1), each of which is integrally connected to the layers of silicone covering adjoining surfaces of the cushion 10. Finally, the side surfaces 42 and 44 of the third portion 34 include, respectively, relatively thin layers of silicone 43 and 45 (see FIG. 4), each of which is integrally connected to the layers of silicone covering adjoining surfaces of the cushion 10. Thus, the layers of silicone covering the side surfaces of the three portions of the cushion 10 make the side surfaces substantially impermeable to water.

The relatively thin layers of silicone covering the above noted surfaces of the generally U-shaped cushion 10 are provided, for example, by applying a relatively thin, uniform layer of liquid silicone over these surfaces. A suitable liquid silicone is commercially available under the trademark "GE Silicone Rubber Caulk Clear." After application, the liquid silicone dries and hardens but remains pliable and resilient. That is, the pad 10 may be flexed without the layers of silicone cracking or breaking. The thickness of the integrally connected silicone layers is preferably approximately one-thirty-second of an inch or less.

Because the generally U-shaped cushion 10 of the present invention is preferably both flexible and resilient, the cushion 10 is preferably manufactured from a material which has these properties. Preferably, the cushion 10 is manufactured from foam rubber. Foam rubber is relatively inexpensive and has the requisite properties of flexibility and resiliency. The cushion 10 may be manufactured by cutting or carving a generally U-shaped length of material, of appropriate dimensions, curvatures, and inclinations from a foam rubber cylinder. A suitable foam rubber cylinder may be obtained from the Industrial Rubber and Supply Company of Tacoma, Washington. These foam rubber cylinders are typically about four inches in diameter and twenty-four inches in length. If the pad is made from a foam rubber cylinder, then the use of the foam rubber cylinder facilitates obtaining the initial curvature of the pad.

In use, and as shown in FIGS. 1–3, the flexible, resilient, generally U-shaped cushion 10 is placed, for example, over a forward portion 51 of the surface of the sink 50. That is, the bottom surface of the first portion 12 of the cushion 10 is placed adjacent the inner surface 54 of the bowl 52, the bottom surface of the second portion 24 is placed over the top surface 72 of the flange 70, and the bottom surface of the third portion 34 is placed adjacent the front surface 78 of the lip 76. Because of the curvature of the first portion and the canting of the third portion, which first and third portions are stretched or tensioned when in place, the pad 10 tends to grip the surfaces of the sink 50.

The upper back and the lower portion of the back of the neck of a person whose hair is to be shampooed within the sink 50, for example, is placed against the planar top surface 36 of the third portion 34 for support. The upper portion of the back of the neck of the person whose hair is to be shampooed is then placed in contact with the silicone covered half of the top surface of the second portion of the pad 10. If the person has relatively long hair, then the relatively long hair will cascade into the bowl 52 over the top surface 14 of the first portion 12 and the half of the top surface 26 of the second portion 24 not covered by silicone. As the shampooing operation proceeds and water is applied to the person's hair, this water will seep into half the second portion 24 as well as the first portion 12 of the cushion 10, through the half of the top surface 26 of the second portion 24 not covered by silicone and through the top surface 14 of the first portion 12 which is also not covered by a layer of silicone. The water absorbed by the first portion and half the second portion of the pad will then gradually seep out of the lower end of the first portion 12 through the rounded lower surface 18, which is also unprotected by a layer of silicone. The water seeping out of the lower end of the first portion 12 falls gently into the bowl 52, without splashing. Thus, the back of the person's neck placed against the top surface of the second portion 24 of the cushion 10 is not only protected from the hard surface of the sink 50, but remains substantially dry because the cushion 10 of the present invention reduces splashing, and because the portions of the cushion 10 with which the person comes into contact are substantially impermeable to water.

A principle advantage of the present invention is that it is relatively inexpensive. This is due to the fact that the materials required to manufacture the present invention, such as foam rubber and liquid silicone, are relatively inexpensive.

Another advantage of the present invention is that the foam rubber constituting the pad 10 has the requisite qualities of flexibility and resiliency while providing the necessary cushioning effect for the back of the neck of a person whose hair is to be shampooed at a sink. Furthermore, the silicone layers covering half the upper surface of the second portion and the entire top surface of the third portion of the pad 10 prevent these portions of the foam rubber from absorbing water and thereby becoming less resilient and less capable of providing a cushioning effect.

Yet another advantage of the present invention is that it is readily adaptable to any sink and simple to use. There is no mechanical paraphernalia associated with the present invention, nor is there any need for the sink or the wall of the sink to have any particular shape or notch. The cushion of the present invention may be readily arranged over the wall of almost any sink, irrespective of the shape of the sink or the shape of the wall of the sink.

Still yet another advantage of the present invention is that due to the shape and resiliency of the pad, the pad has a natural tendency to grip the surface of the bowl, flange and lip of a sink. Thus, no special paraphernalia is required to keep the pad in place on a sink.

The present invention is also advantageous because it may be readily sanitized and is reusable. It is expected that a barber or hair dresser would have at least a day's supply of the cushions with each cushion being used once before being cleaned. That is, after each use, the flexible, resilient cushion of the present invention would be readily removed from the wall of the sink and replaced by a clean cushion with the soiled cushions all readily sanitized, e.g., by washing in a washing machine, or by applying a disinfectant to the cushions. Thus, the flexible, resilient cushion of the present invention may be used again and again.

Still yet another advantage of the flexible cushion of the present invention, as noted above, is that the relatively thin layers of silicone covering half the top surface of the second portion and the whole of the top surface of the third portion of the cushion make these sections of the cushion substantially impermeable to water or other liquids. Thus, in use, these sections of the cushion which provide support for the back of the neck and the upper portion of the back of a person whose hair is being shampooed, for example, will not become impregnated with water and will not tend to loose their resiliency or their ability to provide cushioning support. Furthermore, by not becoming impregnated with water, these sections of the cushion, which sections are in direct contact with the neck of the person whose hair is being shampooed, will avoid moistening the person's neck when the foam rubber is compressed by the weight of the person's neck.

Yet still another advantage of the cushion of the present invention is that it prevents splashing during a shampooing operation at a sink, thereby avoiding any splashing which might produce a moistening of the neck of the person whose hair is being shampooed. That is, by not protecting half the top surface of the second portion and the whole of the top surface and the lower rounded surface of the first portion of the cushion with silicone layers, water applied to the hair of the person can penetrate half the second portion and the first portion of the cushion and gently seep into the sink.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. A cushion adapted to overlie a portion of a sink, which sink includes a bowl having an inner bowl surface, a substantially horizontal surface connected to and projecting outwardly from a top edge of the bowl, and a downwardly directed surface connected to and depending from said substantially horizontal surface, comprising:

a flexible, resilient cushion having a top surface, said cushion being sufficiently large and being adapted to overlie said portion of said sink, and said cushion including a first portion adapted to overlie a portion of said bowl surface, a second portion integrally connected to said first portion and adapted to overlie a portion of said substantially horizontal surface, and a third portion integrally connected to said second portion and adapted to overlie a portion of said downwardly directed surface;

said first portion and said third portion being resilient and initially inclined toward one another, so that when said cushion is mounted on said sink said first and third portions grip said sink; and a portion of said top surface of said cushion including a relatively thin layer of silicone.

2. Apparatus in accordance with claim 1 wherein said first portion includes a first top surface and a contiguous edge surface, said second portion includes a second top surface contiguous with said first top surface, and said third portion includes a third top surface contiguous with said second top surface, said third top surface and a first portion of said second top surface, adjacent said third top surface, each including a relatively thin layer of silicone, said first top surface, said edge surface, and a second portion of said second top surface being permeable to water.

3. Apparatus in accordance with claim 2 wherein said first, second, and third portions each includes a bottom surface covered by a relatively thin layer of silicone.

4. Apparatus in accordance with claim 2 wherein said third top surface is substantially planar.

5. Apparatus in accordance with claim 1 wherein said cushion is generally U-shaped in cross-section.

6. Apparatus in accordance with claim 1 wherein said cushion is manufactured from foam rubber.

7. Apparatus in accordance with claim 1 wherein said second portion includes a bottom surface having a semi-circular groove at opposite ends of said bottom surface.

8. In a cushion adapted to overlie a portion of a sink, which sink includes a bowl having an inner bowl surface, a substantially horizontal surface connected to and projecting outwardly from a top edge of the bowl, and a downwardly directed surface connected to and depending from said substantially horizontal surface, and which cushion includes a first portion adapted to overlie a portion of said bowl surface, a second portion integrally connected to said first portion and adapted to overlie a portion of said substantially horizontal surface, and a third portion integrally connected to said second portion and adapted to overlie a portion of said downwardly directed surface, and each of said first, second, and third portions having first, second, and third top surfaces, respectively, the improvement comprising:

a relatively thin layer of silicone provided on said third top surface;

a relatively thin layer of silicone provided on a first portion of said second top surface, adjacent said third top surface;

said first top surface and a second portion of said second top surface being permeable to water; and said first and third portions being resilient and inclined toward one another.

9. In a cushion adapted to overlie a portion of a sink, which sink includes a bowl having an inner bowl surface, a substantially horizontal surface connected to and projecting outwardly from a top edge of the bowl, and a downwardly directed surface connected to and depending from said substantially horizontal surface, and which cushion includes a first portion adapted to overlie a portion of said bowl surface, a second portion integrally connected to said first portion and adapted to overlie a portion of said substantially horizontal surface, and a third portion integrally connected to said second portion and adapted to overlie a portion of said downwardly directed surface, and each of said first, second and third portions having first second, and third top surfaces, respectively, the improvement comprising:

a relatively thin layer of silicone provided on said third top surface;

a relatively thin layer of silicone provided on a first portion of said second top surface, adjacent said third top surface;

said first top surface and a second portion of said second top surface being permeable to water.

10. A cushion adapted to overlie a portion of a sink, which sink includes a bowl having an inner bowl surface, a substantially horizontal surface connected to and projecting outwardly from a top edge of the bowl, and a downwardly directed surface connected to and depending from said substantially horizontal surface, comprising:

a flexible, resilient cushion, said cushion being sufficiently large and being adapted to overlie said portion of said sink, and said cushion including a first portion adapted to overlie a portion of said bowl surface, a second portion integrally connected to said first portion and adapted to overlie a portion of said substantially horizontal surface, and a third portion integrally connected to said second portion and adapted to overlie a portion of said downwardly directed surface;

said first portion having a concave curvature so that a lower end of said first portion is inclined toward said third portion, and a thickness of said first portion increasing from a lower end of said first portion toward the opposite end of said first portion, adjacent said second portion;

said third portion being inclined toward said first portion, and a thickness of said third portion increasing from a lower end of said third portion toward the opposite end of said third portion, adjacent said second portion; and said second portion having a bottom surface adapted to be in contact with said substantially horizontal surface, said bottom surface including a semi-circular groove at opposite ends of said bottom surface.

11. Apparatus in accordance with claim 10 wherein said first portion includes a first top surface and a contiguous edge surface, said second portion includes a second top surface contiguous with said first top surface, and said third portion includes a third top surface contiguous with said second top surface, said third top surface and a first portion of said second top surface, adjacent said third top surface, each including a relatively thin layer of silicone, said first top surface, said edge surface, and a second portion of said second top surface being permeable to water.

* * * * *